US005199370A

United States Patent [19]

Berquist

[11] Patent Number: 5,199,370

[45] Date of Patent: Apr. 6, 1993

[54] FLOAT AND DECK SYSTEM FOR FLOATING DOCKS

[76] Inventor: DeWayne D. Berquist, 13929 Terrace Rd. NE., Ham Lake, Minn. 55304

[21] Appl. No.: 732,138

[22] Filed: Jul. 18, 1991

[51] Int. Cl.[5] ..... B63B 35/38

[52] U.S. Cl. ..... 114/263; 114/267

[58] Field of Search ..... 114/263, 266, 267, 264; 405/218, 219, 220, 221

[56] References Cited

U.S. PATENT DOCUMENTS

| | | | |
|---|---|---|---|
| 4,223,629 | 9/1980 | Dunlop | 114/263 |
| 4,418,634 | 12/1983 | Gerbus | 114/263 |
| 4,799,445 | 1/1989 | Meriwether | 114/263 |
| 5,048,448 | 9/1991 | Yoder | 114/263 |
| 5,050,524 | 9/1991 | Kyhl et al. | 114/263 |

*Primary Examiner*—Jesus D. Sotelo
*Assistant Examiner*—Stephen P. Avila

[57] ABSTRACT

A floating dock system which comprises a plurality of locatable floats and interlockable deck sections overlying and supported by the floats. For interlock, the deck sections are arranged with interlapping ends for over or underlying next longitudinally adjacent sections with attachment receiving passages along such edges for positive connection therebetween. The deck sections are connectable to the floats to provide a dock of various, desired configurations. The float sections and the deck sections are hollow with the deck sections selectively fillable with expanded foam material. Selectively spaced and located connective passages are provided in the float and deck sections for combining the same into desired configurations and to meet various flotation requirements. Spanning and supporting members to extend between floats are available for particular installations. The variable positioning between deck sections and deck and float sections allows development of docks of various configurations including fingers or arms for slip areas and enlarged platform areas with the completed dock requiring only minimal, if any, water bottom connective devices.

11 Claims, 6 Drawing Sheets

FLOAT AND DECK SYSTEM FOR FLOATING DOCKS

FEDERAL SPONSORSHIP

This invention has not been made under any federally sponsored research and development arrangement nor under any other sponsored research and development program.

RELATED APPLICATIONS

There are no related applications currently onfile in the United States Patent Office which should be considered

FIELD OF THE INVENTION

This invention relates generally to dock structures developed from float and deck sections and more particularly to a floating dock system which incorporates particular float sections and correlated deck sections selectively joinable whereby deck sections may be longitudinally, positively connected and connected deck sections are selectively connectable to spaced float sections for ultimate joinder into a plurality of desired shapes with the resulting unit providing a stable unit for water placement and useage.

SHORT SUMMARY OF THE INVENTION

A floating dock system comprising hollow float sections and hollow deck sections supported on the floats which will virtually eliminate anchoring, location and other support piers or posts normally associated with dock units. The flotation provided by the floats normally maintains the deck above water level and the floats and deck sections are joinable and connectable to provide a substantially stable unit designed to substantially reduce harmful, normally encountered wave actions which results in a long lasting and relatively maintenance free dock unit.

The individual deck sections are provided as hollow, rotationally molded units having an upper non-skid surface spaced from a bottom surface. A plurality of attachment passages are provided along two parallel sides of the deck sections and at stepped areas of the respective ends of the sections to permit the same to be connected to the float sections and to permit longitudinal, overlapped connection of the same. The deck sections may be filled with expandable foam materials.

The individual floats are provided as hollow, rotationally molded units with a waffle patterned, wave action reducing, bottom surface. A plurality of continuous surface attachment passages are provided at various locations through the hollow body to provide for side-by-side attachment thereof and joinder of the deck sections to the uppermost surface thereof.

Various joinder and adaptor elements including float spanning and deck section supporting struts allows the dock designer to construct a dock of various configurations including fingers or arms for slip areas and enlarged walking or platform areas.

The invention provides a combinative system for joining floats and deck sections which results in a substatially stable dock virtually eliminating secondary support or locating systems.

BACKGROUND AND OBJECTS OF THE INVENTION

The applicant is aware of various patents related to dock structures. Such patents include those set forth in the accompanying Prior Art Disclosure Statement. The closest of these patents being that to Berquist, U.S. Pat. No. 3,964,221. The present application reflects substantial improvements over all such art including this particular patent.

Applicant's concept includes two distinct components which are connectable to form dock units of many desired configurations. The first such section is a deck or walking surface unit and the second is a float. Each of the sections is rotationally formed and therefore hollow and is molded from polyethelene with includes Uv inhibitors. The units are formed through rotational molding techniques and thus provide completely hollow, floatable units with all passages formed therethrough being surface continuous or otherwise isolated to eliminate internal water accummulation.

With known molding techniques, surface design is easily attainable and non-skid surfaces are provided on the walking areas of deck sections with a waffle pattern provided on the bottom of the float sections to reduce wave action on the assembled dock. With the applicant's dock, all sections being floatable, it is obvious that a section may be assembled either on shore and pushed from the shore to its final position or it may be constructed by floating sections into place and connecting the same after positioning.

With the applicant's aspects of interlock and overlap, it should be obvious that a multiplicity of shapes and sizes of dock may be provided to include fingers for slips and enlarged platform areas. Applicant has also found that increasing the number of floats below an enlarged platform area will permit placement of structures on such an area to provide, for example, a changing house or storage shed at the end of a dock unit.

It is therefore an object of the applicant's invention to provide a float and deck system which incorporates a plurality of such units arranged for connection and interlock and overlap whereby dock structures of various shapes and design considerations are obtainable.

It is a further object of the applicant's invention to provide a float and deck system for dock construction whereby float and deck sections are selectably located for float use and space variation for affording sufficient flotation and bouyancy to the finished dock.

It is still a further object of the applicant's invention to provide a floating dock incorporating a number of individual float and deck sections wherein a plurality of interlocking and overlapping deck sections are provided for attachment to one another and similarly attachable to a selected number of positioned float sections to provide a continuous flexible deck capable of absorbing oscillatory, wave induced motion.

It is still a further object of the applicant's invention to provide a floating dock incorporating a plurality of hollow platform deck sections and a plurality of hollow floatable float members having means for interconnecting the deck and float sections in a manner which permits float spacing with additional support struts supplied between spaced floats.

It is still a further object of the applicant's invention to provide a floating dock incorporating a plurality of spaced float sections and deck sections mounted and supported thereby with support struts extending between the floats and offering lateral support to the overlying deck sections.

These and other objects and advantages of the applicant's invention will more fully appear from a consideration of the accompanying drawings and description.

DESCRIPTION OF A PREFERRED FORM OF THE INVENTION

In accordance with the invention and the accompanying drawings, the applicant's invention consists of two primary elements. These are a rotationally formed float and a rotationally formed deck. Illustrated are two float sections 11, 12 differentiating only in width and two deck sections 13, 14 differentiating only in width.

Figure 5:
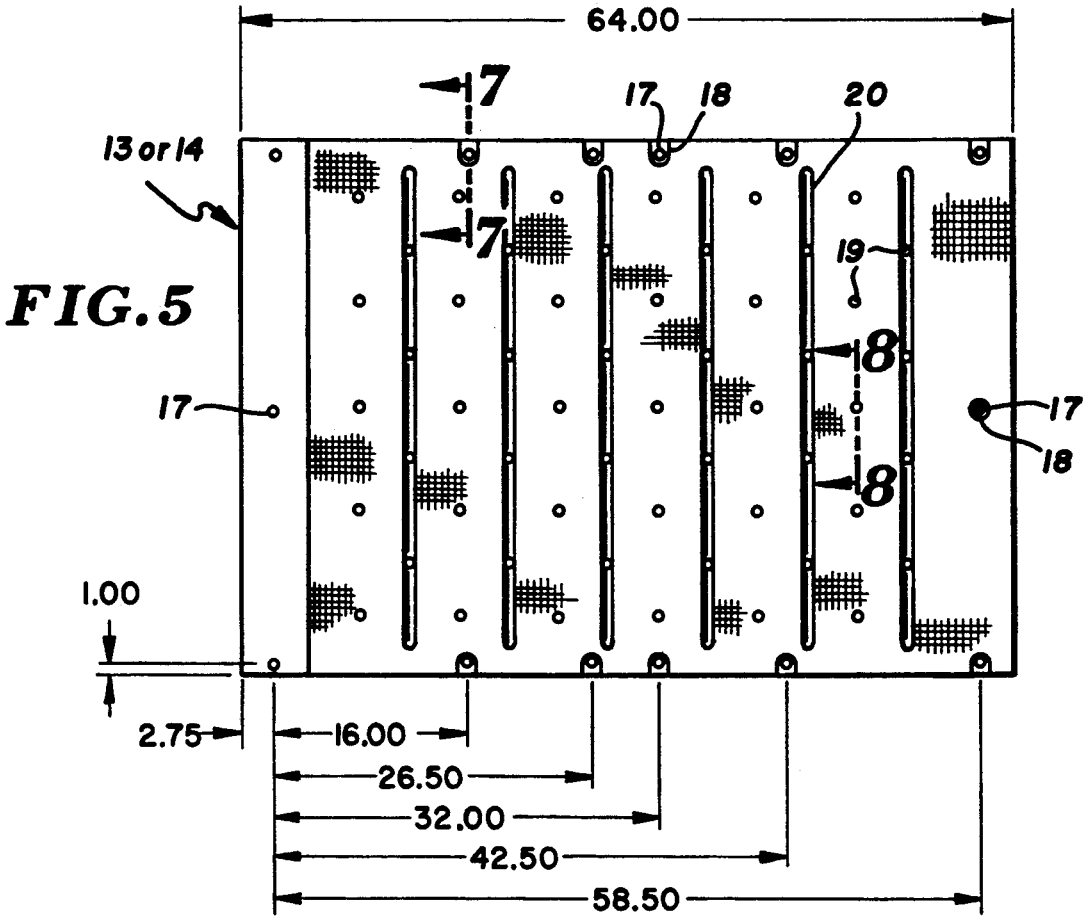
FIG. 5 is a top plan view of a deck section which includes dimensions which allows correlation to the float section of FIG. 9.
Figure 6:
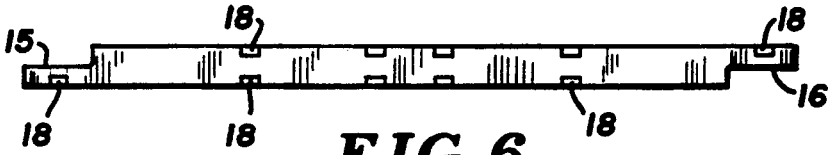
FIG. 6 is a side view of the deck section of FIG. 5.
Figure 7:
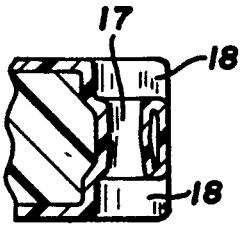
FIG. 7 is a vertical section taken substantially along Line 7—7 of FIG. 5.
Figure 8:
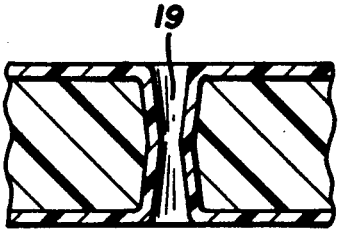
FIG. 8 is a vertical secction taken substantially along Line 8—8 of FIG. 5.
Figure 9:
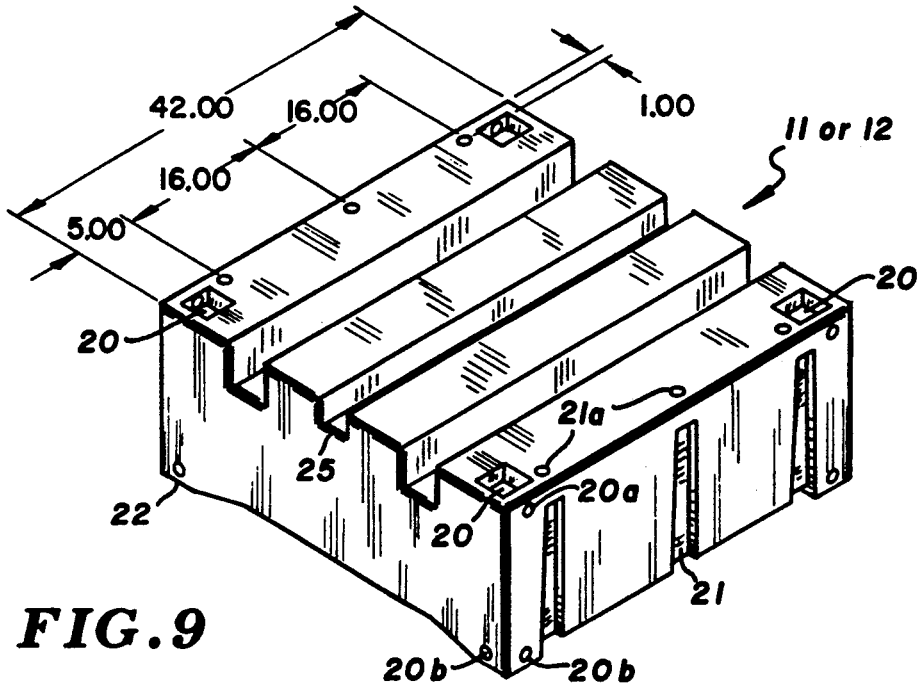
FIG. 9 is a top perspective view of a float section again including dimensions to allow correlation to the deck section of FIG. 5, it being understood that the dimensions of FIGS. 5 and 9 are examples for a specific float and deck section and are not to be considered as controlling to the concept of the invention.

FIGS. 5, 6, 7 and 8 are pertinent to both deck sections 13, 14 with the longitudinal dimensions illustrated being applicable to a selected longitudinal dimension utilized by applicant and corresponding to the longitudinal dimensions of the float 11, 12 of FIG. 9. As illustrated therein, the endmost portions 15, 16 of a deck 13 or 14 are arranged for overlapping connection and passages 17 are formed therethrough for connection of one deck section to another. The comparable height of an overlap 15 or 16 is ½ the height of the deck 13 or 14. The passages 17 therethrough are illustrated in FIG. 7 which illustrates such passage 17 positioned within a shouldered or reduced height area 18 with isolated from the interior of the deck section 13 or 14. Therefore attachment elements passing therethrough will normally be below or level with the surface of the section. As illustrated in FIG. 5, a textured surface is molded directly into the deck 13 or 14 and a plurality of lateral grooves 20 are also molded directly intosuch surface. Passages 19 are interspaced within such grooves 20 and pass entirely through such deck sections as drains and as strengthening columns. The opposite surface of either deck section 13 or 14 is provided with similar longitudinal grooves and associated passages 19 thus accounting for the number of such passages appearing on the illustrated surface. Applicant has filled the hollow interior of the deck section 13 or 14 with expanded foaming materials to increase strength and insure floatation thereof by preventing water from entering the hollow unit.

It should be noted that applicant has chosen not to illustrate all of the details of the deck sections on the various views due to the sizing of the illustrations which would only be complicated by such showing.

Figure 10:
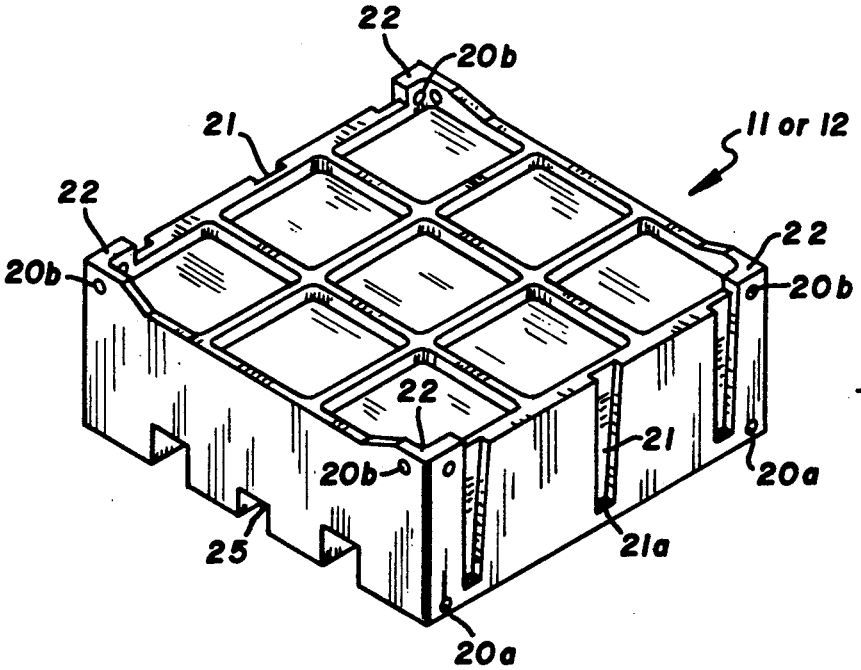
FIG. 10 is a bottom perspective view of a float particularly illustrating the waffle, wave absorbing structure thereof; and, FIG. 11 is a side elevation of a double connector for joinder of deck sections in side-by-side relation where there is no underlying float.

The floats 11 or 12 are illustrated in perspective in FIGS. 9 and 10 and longitudinal, representative dimensions are utilized for correlation to the deck sections 13 or 14. As illustrated in FIG. 9, downwardly extending access areas 20 are provide in the respective upper corners of the float to allow access to a connective aperture 20*a* in the side of the float to allow side-to-side joinder thereof. Similarly, vertically upwardly directed access slots 21 are provided in the sides of the floats to allow access to deck attachment apertures 21*a* in the top surface of the floats. As illustrated in FIG. 9 both floats are provided with at least one longitudinally extending strut receiving groove 25. The wider floats 11 normally have three such grooves with the center such groove being devoted to strut location while the two remaining or outer grooves are available for service lines such as water, electrical, etc. The narrow float 12 has one such groove to receive a support strut. The struts are described hereinafter.

As illustrated in FIG. 10, the bottom of either float 11 or 12 is provided with an integrally molded, raised waffle pattern to serve as a wave effect reducing baffle and access to connector receiving passages 20*b* through the sides of the float is provided through the depending corner portions 22.

Figure 1:
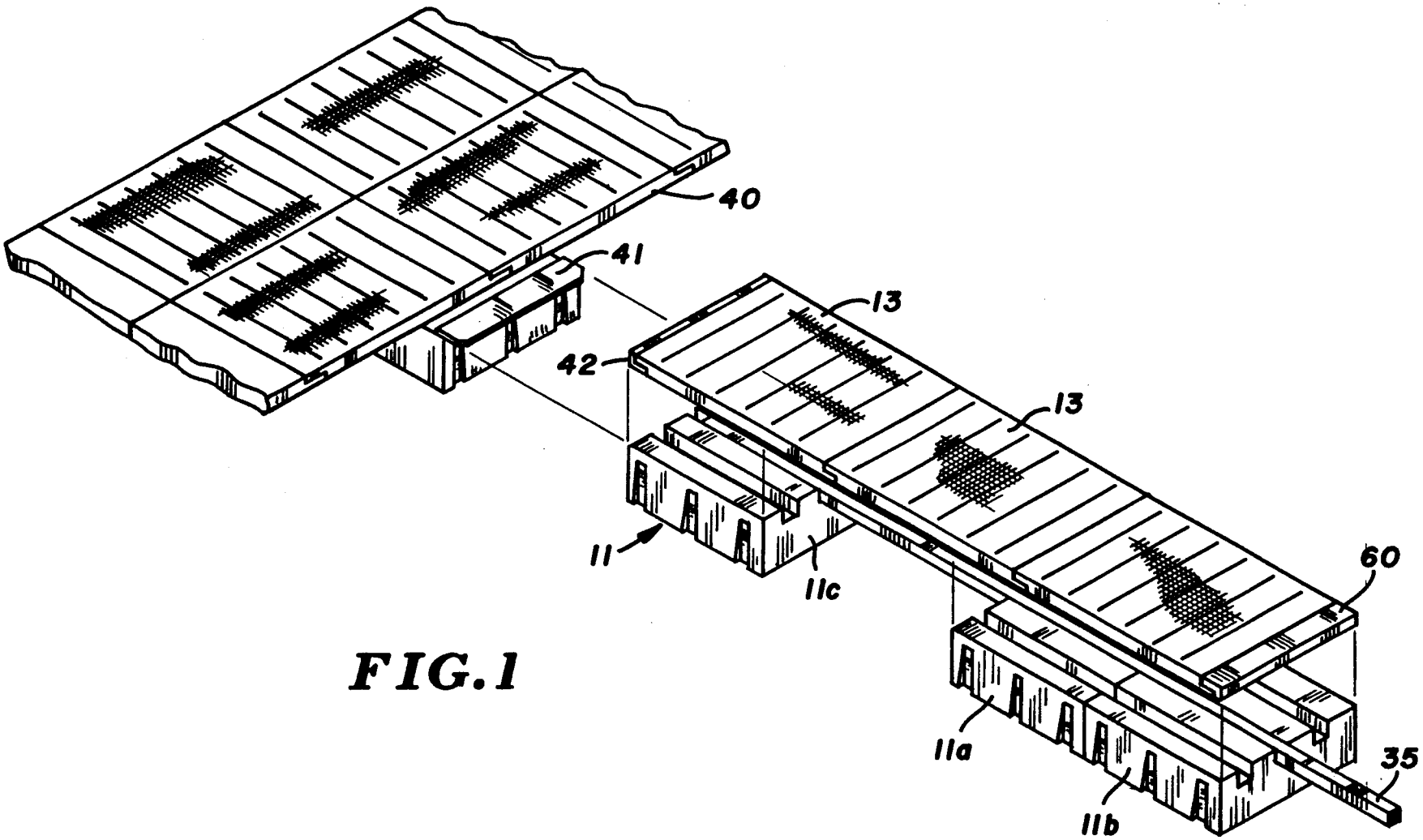
FIG. 1 is a perspective view of a combination of float and deck sections of a first particular size and illustrating a support extending between floats with an enlarged end or platform area being spaced from the walkway formed from a plurality of joined deck sections.
Figure 2:
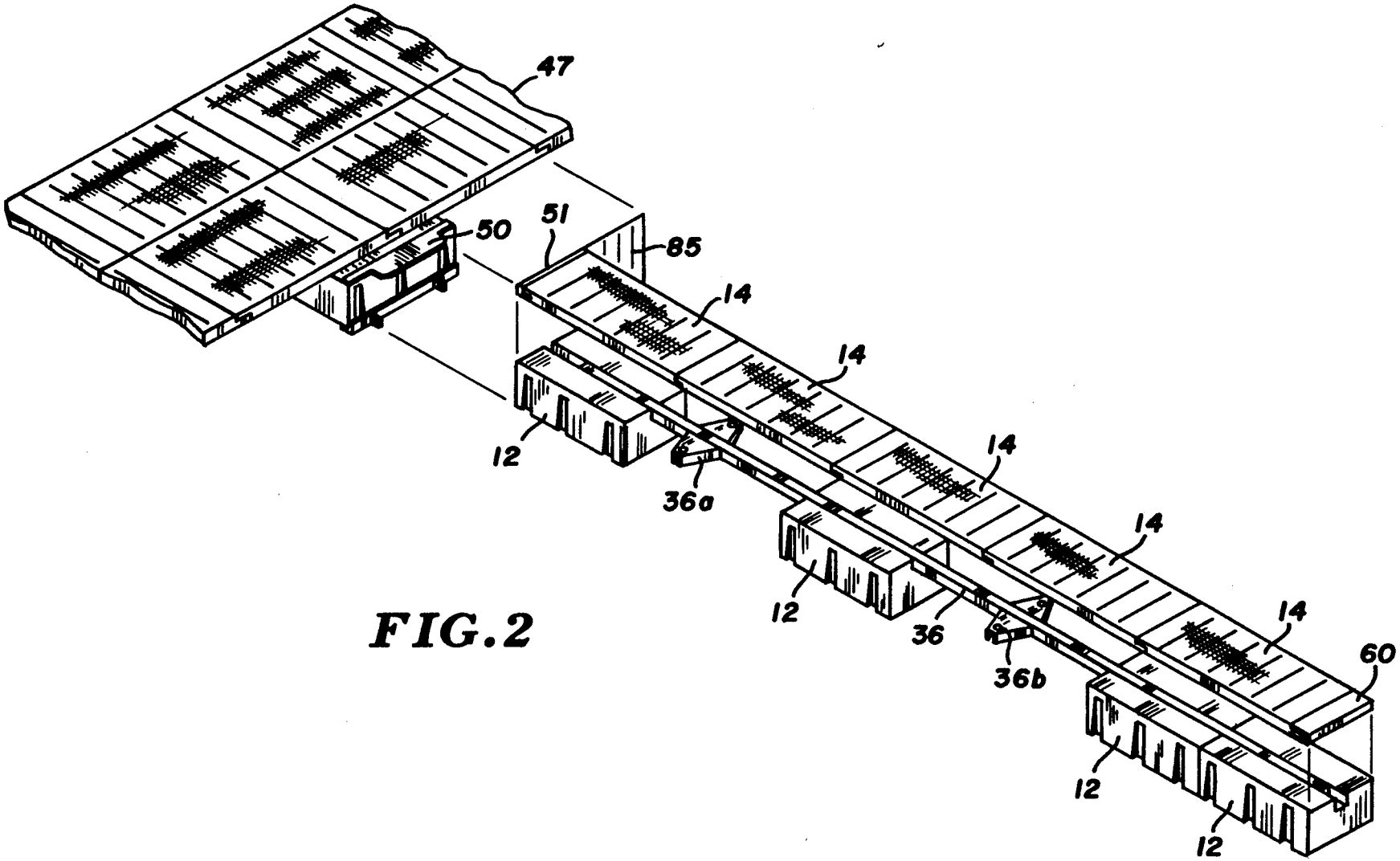
FIG. 2 is a perspective view of a combination of float and deck sections of a second particular size and illustrating a winged support extending between floats with an enlarged end or platform area spaced from the walkway formed from a plurality of joined deck sections.
Figure 3:
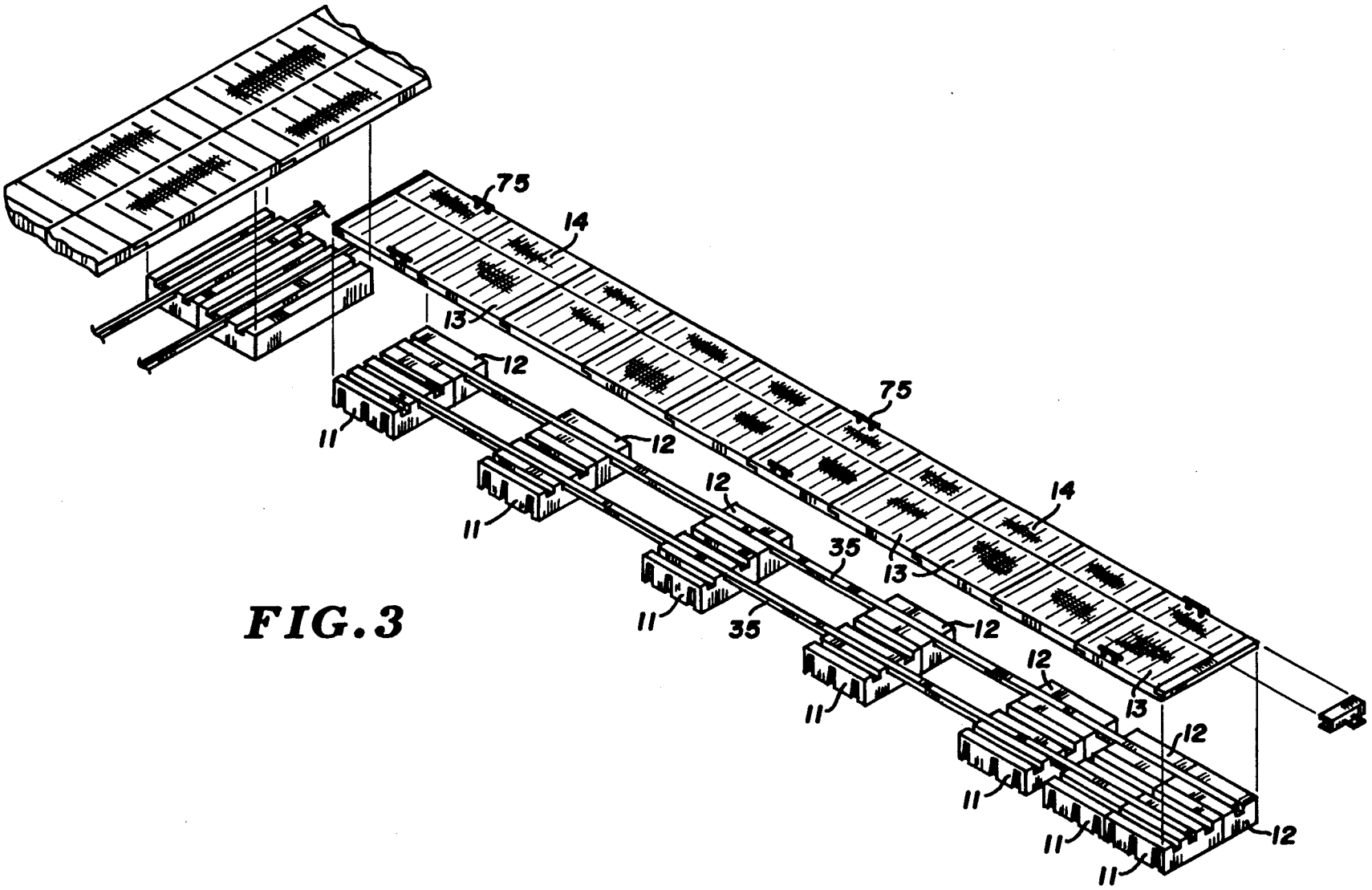
FIG. 3 is a perspective view of a combination of float and deck sections combining the sizes of FIGS. 1 and 2 also illustrating laterally joined float and deck sections and illustrating various spacing between float sections.
Figure 4:
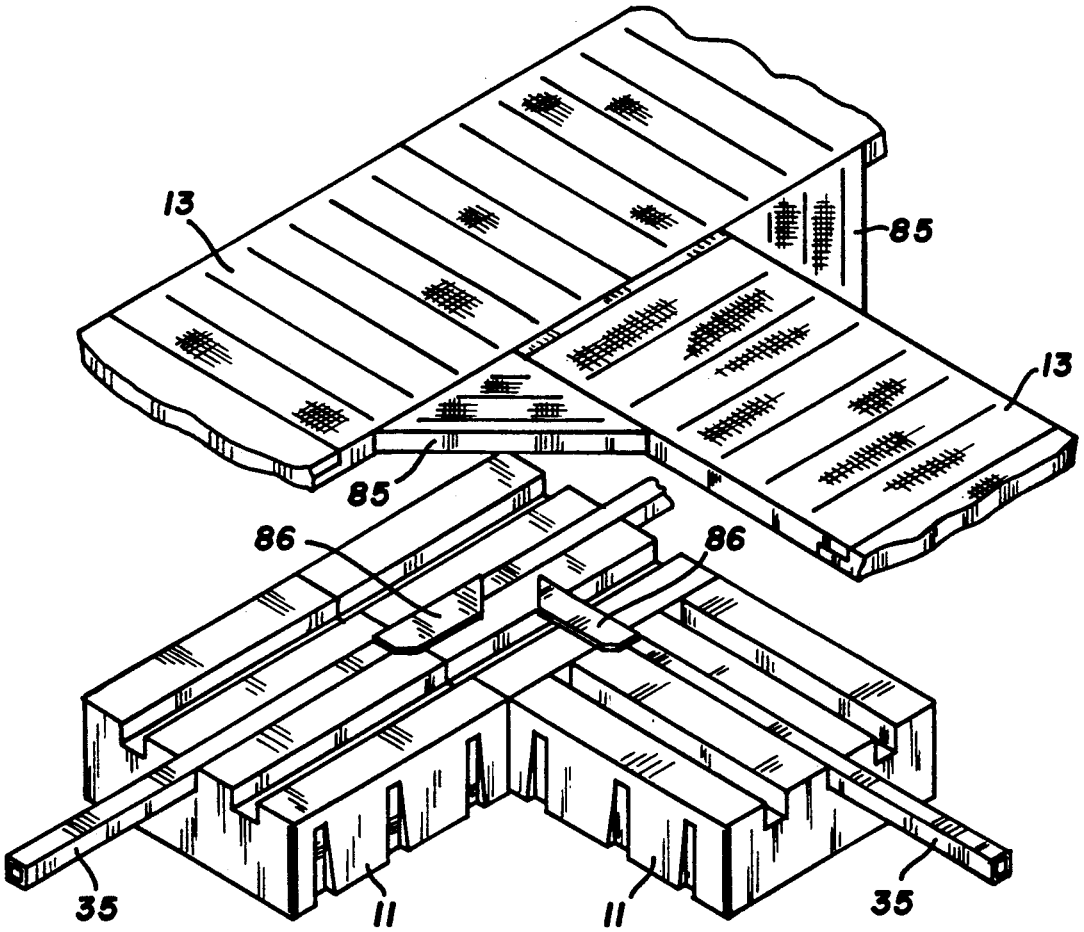
FIG. 4 is a perspective view illustrating a typical finger or lateral arm joinder including a corner insert therefore.

Typical floating dock units obtained from joinder of the float 11, 12 and deck sections 13, 14 are illustrated in FIGS. 1, 2 and 3 with a corner or finger structure illustrated in FIG. 4.

FIG. 1 illustrates a longitudinally extending walkway section 30 comprising a plurality of the wider deck sections 13 with respective overlapping longitudinal ends joined to one another, a plurality of adjacent and spaced wider floats and a supporting strut 35 arranged in the center groove 25 of a float 11. The strut 35 is simply a support member and is selectively attachable to deck sections.

As also illustrated in FIG. 1, a larger area 40 comprising side-by-side sections is shown in displaced position with respect to the end of the longitudinally joined, walkway sections. To accomodate this situation, an adaptor 41 is provided to be attached to a float section and both the longitudinal end of a deck and the side of the offset deck structure. A filler block 42 is also illustrated at the longitudinal end of the walkway.

FIG. 1 also illustrates one float spacing with two floats 11*a*, 11*b* closely spaced to one another, the third 11*c* being spaced therefrom. A comparison of the longitudinal dimensioning of the deck and float sections as available from FIGS. 5 and 9 illustrate this possible combination.

Figure 11:
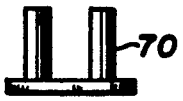

FIG. 2 is an illustration of a floating dock comprising the narrow deck 14 end float sections 12. Again, the sections of deck 14 are longitudinally joined through utilization of passages 17 and are joined to the float sections through utilization of passages 17 with appropriate connectors. Again, the illustrated longitudinal spacing allows for deck section joinder either directly over a float or in the area between floats. In the condition illustrated in FIG. 2, a winged strut 36 is provided having lateral wings **36*a* with apertures 36*b* for attachment to the deck sections. Again, FIG. 2 illustrates available float spacing. FIG. 2 also illustrates an enlarged, what has been termed platform area 47 with deck units, either wide or narrow joined in both longitudinal and side-by-side fashion. An adaptor 50 is provided which will accomodate the narrower width of the narrow deck sections. Similarly, an adaptor, closure end 51 end may be provided at the end of the longitudinal walkway as formed by the deck sections 14. Similarly a closure of FIG. 3 illustrates a combined width dock having wide 11 and narrow 12 float sections, wide 13 and narrow deck 14 sections and unwinged support struts 35. It should be noted that the spacing of floats varies with abutting floats, minimally spaced and maximum spaced floats. This is simply to illustrate the flexibility of the float and deck system in providing floating docks. This Figure also illustrates side-by-side deck section joinder and FIG. 11 illustrates a U-shaped member 70 to achieve such joining. This member 70 provides internally tapped, upright members to receive threaded fasteners after the same have passed through the respective passages 17 along the sides of a deck section thus allowing top surface tightening. A further aspect of the use of the invention is illustrated by the inclusion of a cleat 75** in a deck section to illustrate the utility available with the system. Obviously other such fixtures may be easily utilized.

FIG. 3 again illustrates an enlarged area 80 to simply illustrate the concept of lateral or finger extensions that are available without departing to or adding to the invention and the illustrated units.

FIG. 4 illustrates a typical corner configuration wherein a right angle unit 85 is provided for corner filling for esthetic effect, strength and safety considerations. Floats 11, decks and struts 35 are provided and an interlock unit 86 is illustrated. The corner element 85 is rotationally molded with accomodating apertures spaced in accordance with the spacing in the float and deck sections.

Applicant has found that the float and deck system allowing floating dock design and construction as disclosed herein has a number of advantages over available units. The resulting unit floats to virtually eliminate normally provided support posts and lifting structures for maintaining the walking surfaces out of the water. The designed shape of the decks provides for permitted undulations due while maintaining supporting characteristics and lateral stability with minimal outboard end locating or anchoring being required to maintain desired position of the dock with respect to shore. The material comprising both sections is virtually maintenance free and the textured deck section surface provides a high degree of tractive mobility Applicant believes that the float and deck system disclosed herein provides a unique and uniquely simple floating dock arrangement affording desired stabilty and strength while similarly affording constructive or assembly advantages over other dock systems.

What Is claimed is:

1. A floating dock structure including:

a. a number of generally rectangular, hollow deck sections having tops, bottoms, sides and ends;

b. each of said deck sections having a plurality of connective passages spaced along the respective sides thereof;

c. each of said deck sections providing stepped areas on opposite ends thereof for overlapping attachment of said sections in longitudinal relation;

d. a number of generally rectangular, hollow float sections having tops, bottoms, sides and ends;

e. each of said float sections having a plurality of connective passages extending from said tops to at least a selected portion of said sides whereby connective means may be arranged through said deck sections and said connective passages for direct attachment of deck sections to said float sections; and, f. the spacing of said passages in said deck sections and said float sections being selected to permit selected placement and connection of said deck sections to said float sections.

2. The floating dock structure as set forth in claim 1 and each of said stepped areas of said deck sections providing at least one connective passage therethrough for positive joinder thereof to another deck section.

3. The floating dock structure as set forth in claim 1 and said float sections including connective passage means through selected areas of said sides whereby a pair of said floats may be joined in side by side relation.

4. The floating dock structure as set forth in claim 1 and said bottom of said float sections including a raised waffle pattern for absorption of and reduction of water movement thereagainst.

5. The floating dock structure as set forth in claim 4 and said waffle pattern including outstanding rib and depressed surface areas integrally molded into said bottom.

6. The floating dock structure as set forth in claim 1 and U-shaped connector means for joinder of said deck sections in side-by-side relation.

7. The floating dock structure as set forth in claim 1 and adaptor means attachable to sides of said deck sections through said connective passages arranged along said sides and adapted to receive ends of said deck sections for connection thereto whereby laterally extending fingers may be provided in relation to a longitudinally arranged and connected deck.

8. The floating dock structure as set forth in claim 7 and hollow, generally right angled corner sections are attachably arranged for placement and joinder into a corner formed by an extending finger.

9. The floating dock structure as set forth in claim 1 and the number of float sections and placement thereof with respect to said deck sections provides sufficient bouyancy for placement of structures thereon.

10. A floating dock structure including:

a. a number of generally rectangular, hollow deck sections having tops, bottoms, sides and ends;

b. each of said deck sections having a plurality of connective passages spaced along the respective sides thereof;

c. each of said deck sections providing stepped areas on opposite ends thereof for overlapping attachment of said sections in longitudinal relation;

d. a number of generally rectangular, hollow float sections having tops, bottoms, sides and ends;

e. each of said float sections having a plurality of connective passages extending from said tops to at least a selected portion of said sides whereby connective means may be arranged through said deck sections and said connective passages for direct attachment of deck sections to said float sections;

f. said float section connective passages including access areas positioned in said sides of said floats in close proximity to said connective passages whereby a relatively short connective element is accessible and may be utilized in connecting said deck sections to said float sections; and g. the spacing of said passages in said deck sections and said flat sections being selected to permit selected placement and connections of said deck sections to said float sections.

11. A floating dock structure including:

a. a number of generally rectangular, hollow deck sections having tops, bottoms, sides and ends;

b. each of said deck sections having a plurality of connective passages spaced along the respective sides thereof;

c. each of said deck sections providing stepped areas on opposite sides thereof for overlapping attachment of said sections in longitudinal relation;

d. a number of generally rectangular, hollow float sections having tops, bottoms, sides and ends;

e. each of said float sections having a plurality of connective passages extending from said tops to at least a selected portion of said sides whereby connective means may be arranged through said deck sections and said connective passages for direct attachment of said deck sections to said float sections;

f. the spacing of said passages in said deck sections and said float sections being selected to permit selected placement and connection of said deck sections to said float sections;

g. each of said float sections including a strut receiving groove formed on the upper surface thereof;

h. supporting struts received in said float grooves in underlying relation to deck sections received thereon; and i. said supporting struts including laterally arranged wing sections positionable under an attachable deck section received thereon.

* * * * *